US005384998A

United States Patent [19]

Tanaka et al.

[11] Patent Number: 5,384,998

[45] Date of Patent: Jan. 31, 1995

[54] CURVED PANEL

[75] Inventors: Mamoru Tanaka; Shinichi Kaneda, both of Nara, Japan

[73] Assignee: Kokuyo Co., Ltd., Osaka, Japan

[21] Appl. No.: 924,062

[22] PCT Filed: Jan. 4, 1991

[86] PCT No.: PCT/JP91/00001

§ 371 Date: Sep. 2, 1992

§ 102(e) Date: Sep. 2, 1992

[87] PCT Pub. No.: WO92/12378

PCT Pub. Date: Jul. 23, 1992

[51] Int. Cl.[6] ..... E04C 2/38

[52] U.S. Cl. ..... 52/630; 29/897.32; 52/222

[58] Field of Search ..... 52/630, 245–249, 52/821–823, 222; 29/897.32; 220/641, 642, 4.12, 4.17, 4.25

[56] References Cited

U.S. PATENT DOCUMENTS

| | | | |
|---|---|---|---|
| 588,716 | 8/1897 | Irwin | 220/641 |
| 777,950 | 12/1904 | Huenergardt | 220/640 |
| 832,290 | 10/1906 | Brown | 52/266 |
| 1,099,570 | 6/1914 | Nicholas | 220/641 |
| 1,193,155 | 8/1916 | Klenk | 220/641 |
| 1,778,606 | 10/1930 | Proctor | 52/266 |
| 2,263,510 | 11/1941 | Lindsay | 52/246 |
| 4,808,246 | 2/1989 | Albrecht et al. | 148/11.5 |
| 4,978,564 | 12/1990 | Douglas | 52/720 |

FOREIGN PATENT DOCUMENTS

| | | | |
|---|---|---|---|
| 55-27397 | 2/1980 | Japan . | |
| 62-89413 | 6/1987 | Japan . | |
| 628428 | 8/1949 | United Kingdom | 220/640 |

*Primary Examiner*—James L. Ridgill, Jr.

*Attorney, Agent, or Firm*—Banner, Birch, McKie, and Beckett

[57] ABSTRACT

A curved panel including a panel body and a pair of reinforcing members fixed to the panel body and arranged so that a planar restorative force of the panel body is balanced by a resilient force of each of the pair of reinforcing members so as to keep the panel body at a predetermined curvature. The panel body is made of resiliently deformable material including a face portion at (a) each of a first pair of opposite sides to which a deformable bent portion is attached which allows the face portion of the panel body to be curved to the predetermined curvature and at (b) each of a second pair of opposite sides to which a reinforcing bent portion is attached which keeps the second pair of opposite sides linear. The reinforcing members have a curvature greater than the predetermined curvature and are fixed to the deformable bent portions of the panel body.

14 Claims, 6 Drawing Sheets

CURVED PANEL

FIELD OF THE ART

This invention relates to a curved panel so designed as to be easily formed into a desired curvature by curving the panel body and fixing reinforcing members to the curved panel body.

BACKGROUND ART

The recent tendency in designing furniture and architecture is that curved surfaces are positively employed in various parts from the viewpoint of design and function. Works produced from such a viewpoint are for example desks and tables having curved front panels, doors and partition walls the whole face plates of which are curved, arched ceilings having curved interior surfaces, and pillars circumferentially covered with a decorative hollow cylindrical member.

The front panels, face plates, interior surfaces and decorative members of the above-mentioned types are usually made of steel plate by pressing. For pressing such material those dies which conform to the desired shapes of the products are required. If the abovementioned relatively large-sized panel is to be formed by this method, the die must be as large as the panel to be formed and becomes expensive. As many dies as there are various kinds of products are required, with resulting increase in the manufacturing cost. Large-sized dies would necessarily require a large-sized machine. Since pressing utilizes plastic deformation, a strain is left in the pressed part after the exterior force has been removed. Therefore, the larger the curved surface is, the higher degree of precision is required for pressing. Otherwise, an unnecessarily large strain would be left in the pressed workpiece, so that it would become difficult to produce a good curved surface in the finished product.

In view of the above problems, this invention has been made, its object being to provide a curved panel which has various advantages such that it is possible to reduce the size of the apparatus, easily produce products of various specifications, reduce the manufacturing cost and improve the quality of the finished curved surface.

DISCLOSURE OF THE INVENTION

To accomplish the above object the invention has the following construction.

The curved panel of the invention comprises a panel body and a pair of reinforcing members and is so arranged that the resilient force of the panel body to be restored to a flat condition balances the resilient force of the reinforcing members so as to keep the panel body at a predetermined curvature. The curved panel is characterized by that the panel body is a flat member made of resiliently deformable material and comprising a face portion at each of the two opposite sides of which a deformable bent portion is provided which allows the face portion to be curved and at each of the other two opposite sides of which a reinforcing bent portion is provided which keeps the other two opposite sides of the face portion linear; and that the reinforcing members have a curvature greater than the above-mentioned predetermined curvature, and are fixed to the deformable bent portions of the panel body having been forcedly curved.

The curvature of the panel body need not necessarily be uniform over the whole face portion of the panel body. In particular, if the face portion is divided into minute sections along the length of the deformable bent portions, each of the sections may have a different curvature from those of the other sections provided that the reinforcing members have a greater curvature in each corresponding section. Some of the sections of the panel body may be plane. The description that the curvature is relatively great means that the radius of curvature is smaller except in linear sections.

In the panel body of the above construction, with the two opposite sides thereof provided with the reinforcing bent portions being kept linear, the other two opposite sides thereof provided with the deformable bent portions are curved by application of an artificial force thereto along the curve of the reinforcing members, and the reinforcing members are fixed to the curved bent portions, and then the artificial force is removed, whereupon the resilient force of the panel body to be restored to a plane counteracts the resilient force of the reinforcing members to be restored to their original curvature in opposite directions to each other, so that they balance to keep the panel body at a desired curvature.

The processing steps required for the curved panel are to form the deformable bent portions and the reinforcing bent portions at each pair of sides of the panel and to form the reinforcing members. To make the panel it suffices to work an elongated member and it is not necessary to work the whole of a plate. Therefore, when a large panel is to be made, a smaller machine suffices as compared with pressing the whole of a plate, with resulting reduction of the cost involved. If products of various specifications are to be made, the curvature of the reinforcing members has only to be changed without increasing the cost involved. Since in accordance with this method the panel is curved within the range of its elasticity, the force to restore the panel to its plane condition acts to remove strain uniformly all over the face portion of the panel, so that the panel has a curved surface of very high quality.

The invention includes the following embodiments. The deformable bent portion may be a flange provided with cuts longitudinally spaced apart, or an L-shaped portion provided with cuts longitudinally spaced apart, or a portion shaped like the letter of and provided with cuts longitudinally spaced apart. The reinforcing member may be a reinforcing plate made by bending a steel to an L-shape in cross section, a reinforcing channel member made by bending a steel plate to the letter of in cross section, a reinforcing pipe made by bending a steel plate, or a member made of a shape memory alloy which is restored to a greater curvature than a desired curved surface when heated above the normal temperature.

BRIEF DESCRIPTION OF THE DRAWING

Figure 5:
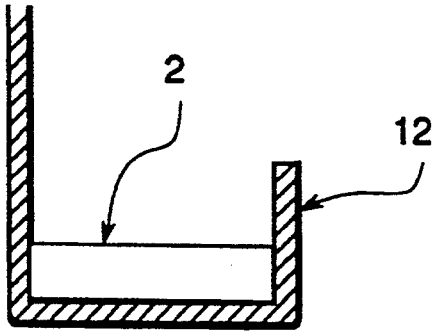

FIG. 1 is a perspective view of the curved panel; FIG. 2 is a perspective view of part of the panel body before it is resiliently curved; FIG. 3 is a plan view of the part shown in FIG. 2 in unfolded condition; FIG. 4 is a perspective, exploded view of the panel; FIG. 5 is a transverse view of a modified form of the deformable bent marginal portion of the panel; FIG. 6 is a perspective view of part of the panel after assemblage; FIG. 7 is a view showing the operation of the invention; and FIG. 8 is a view showing an example of use.

BEST MODES OF EMBODYING THE INVENTION

One embodiment of the invention will be described below with reference to the drawing.

Figure 1:
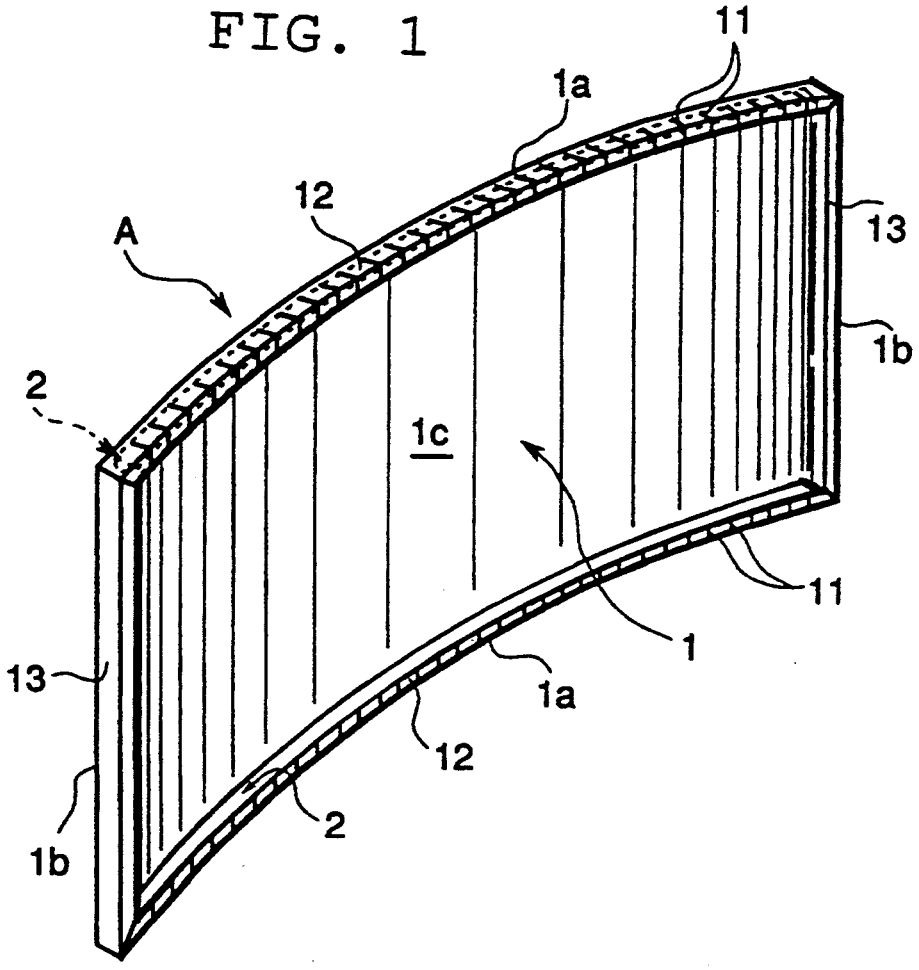
FIGS. 1 to 8 show one embodiment of the invention.
Figure 2:
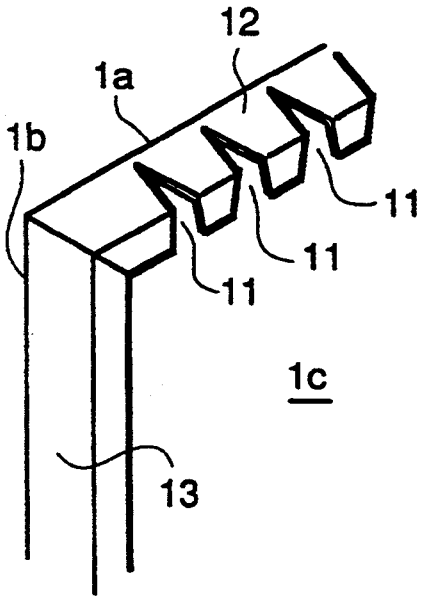
Figure 3:
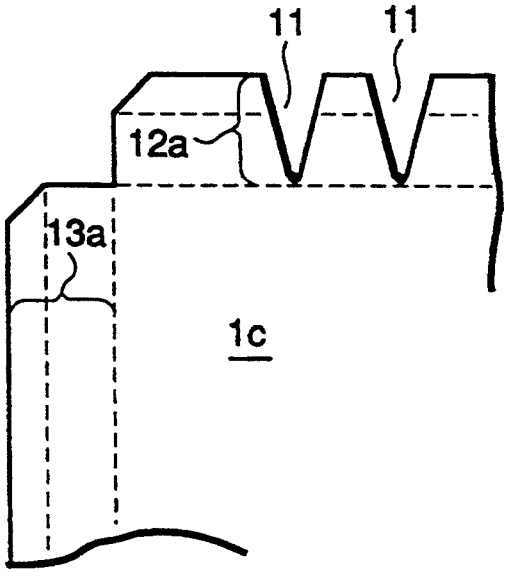

As shown in FIG. 1, the curved panel A comprises a curved panel body 1 and a pair of reinforcing plates 2 fixed to the opposite sides or edge of the panel body 1 so that the resilient force of the panel body 1 to be restored to its flat or planar condition is balanced by the resilient force of the reinforcing plates 2 to be restored to their original curvature shape in the opposite direction thereby to keep the panel body 1 in a desired curved condition.

In particular, the panel body 1 is a resiliently deformable thin steel plate, which is provided at its two opposite sides 1*a*, 1*a* with a deformable bent portion 12 having a plurality of sawtooth cuts 11, and at the other two opposite sides 1*b*, 1*b* with a reinforcing bent portion 13 without such sawtooth cuts formed therein. To form the bent portions 12 and 13, a steel plate is stamped so that along the four sides of a face plate portion 1*c* bendable marginal portions 12*a* and 13*a* are left, which are then deformed like the letter L in cross section by roll forming. The bent marginal portions 12 and 13 are connected at the four corners by welding. In the stamping process the sawtooth cuts 11 are formed in the bendable marginal portions 12*a*. The cuts 11 are V-shaped and have a bottom not pointed but rounded. Due to the arrangement, when an exterior force acts on the face portion 1*c* of the panel body 1, the face portion 1*c* is comparatively easily curved along the deformable bent portions 12, but hardly along the reinforcing bent portions 13.

Figure 4:
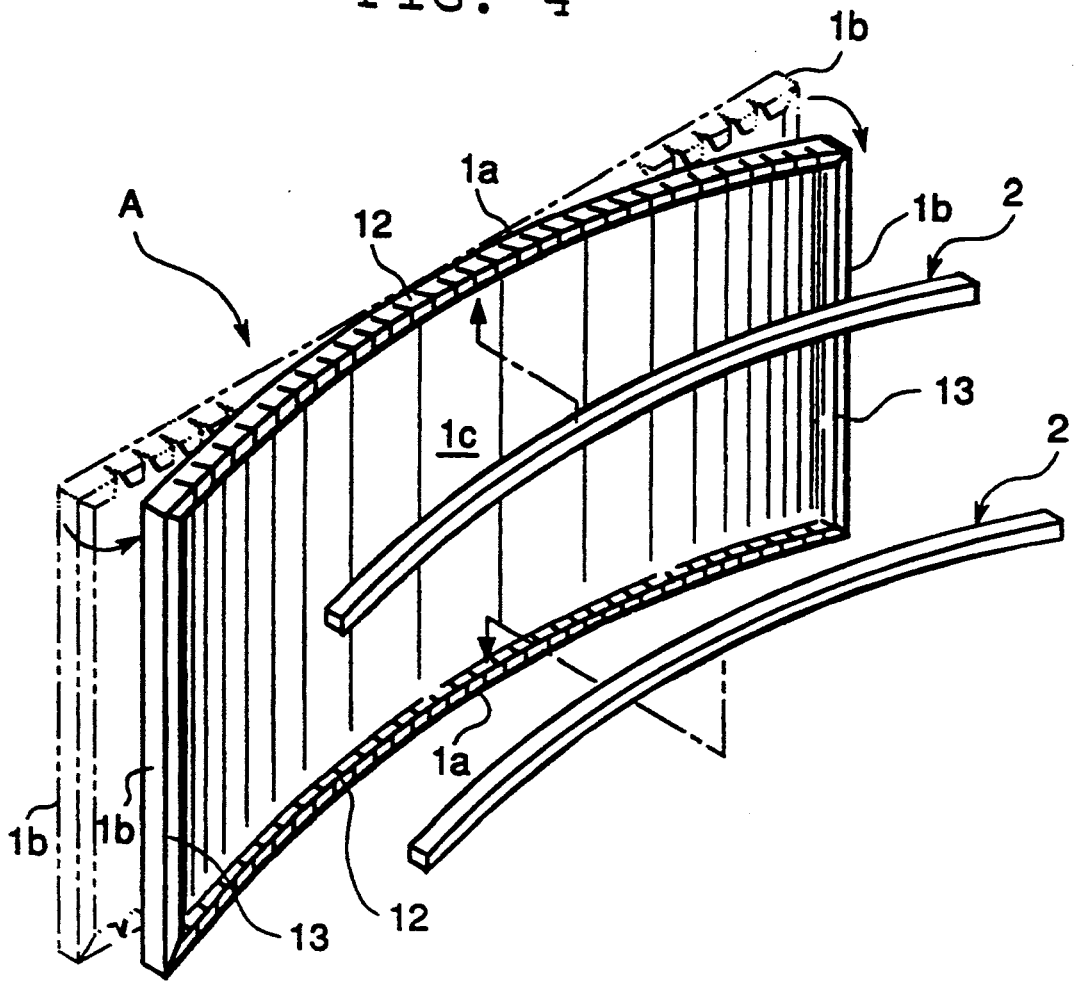

As shown in FIGS. 1 and 4, the reinforcing members 2 are made of a thick steel plate cut by laser into an arcuate member having a curvature slightly greater than that of the curved surface of the panel to be manufactured. The reinforcing members have a cross-sectional shape substantially corresponding to that of the space defined inside the deformable bent portions 12 and a length substantially equal to that of the bent portions 12.

Figure 6:
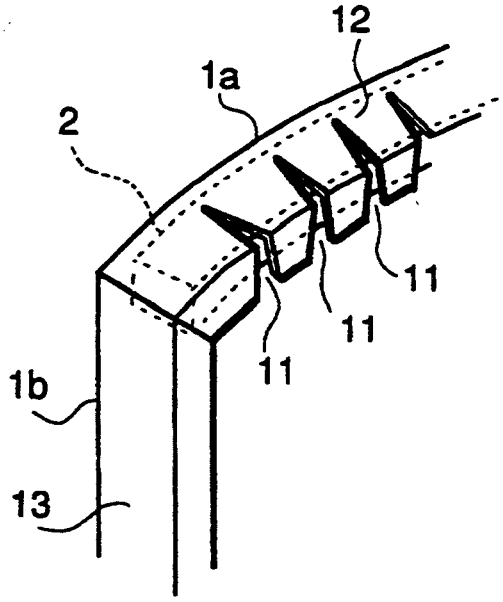
Figure 7:
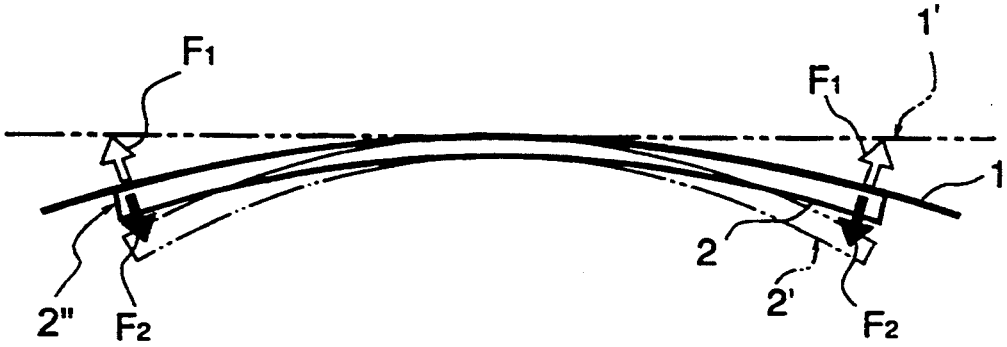

With the opposite sides or edges of the panel body 1 provided with the reinforcing bent portions 13 being held straight, an artificial force is applied to the two opposite sides or edges of the panel body 1 provided with the deformable bent portions 12 so as to curve it into conformity with the curvature of the reinforcing members 2 as shown in FIG. 4, and the elongatedly curved reinforcing members 2 are placed inside the upper and lower bent portions 12 of the curved panel body 1 and secured therein by spot welding as shown in FIGS. 5 and 6. Then the artificial force is removed to complete the assembly. Under the conditon, as shown in FIG. 7, the resilient force F1 of the panel body 1 to be restored to the flat or planar condition 1' shown in phantom line counteracts the resilient force F2 of the reinforcing member 2 to be restored to the original curvature, greater curvature 2' shown in phantom line 1', so that the panel body 1 and the reinforcing member 2 take the intended or predetermined curvature at the position shown in solid line (which is a position 2'' of lesser curvature for reinforcing members 2) where the two forces balance.

Since the curved panel A is of the above-mentioned construction, the processing steps required of making the illustrated embodiment is the roll forming step to form the deformable bent portions 12 and the reinforcing bent portions 13 at the two opposite sides or edges 1*a*, 1*a* and 1*b*, 1*b*, resepctively, and the cutting step by laser to form the reinforcing plates 2. Thus it is possible to complete production of the panel A by merely processing an elongated member, so that when a large-sized panel is to be made, a smaller machine tool suffices than if the whole surface of a plate is machined by a press, with resulting reduction of the manufacturing cost. Moreover, since laser cutting is generally conducted by numerical control, it is possible to change the curvature of the reinforcing plates by merely changing the set numerical values, thereby to easily produce curved panels of different specifications. In addition, since according to the method the face portion 1*c* of the panel body 1 is curved within the range of its elasticity, the force to restore the curved face portion 1*c* to its flat condition acts to remove strain in each and every part thereof, thereby to produce a good curved surface at the portion where it balances the reinforcing plates 2.

Figure 8:
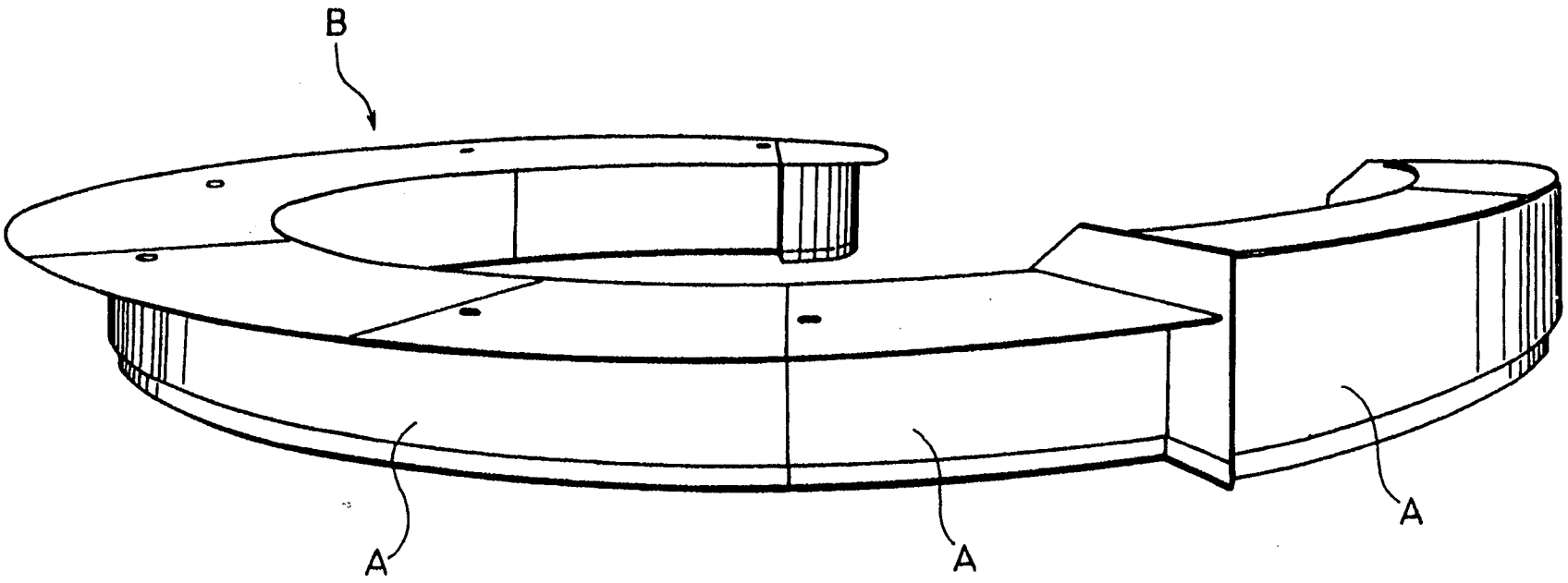
Figure 9:
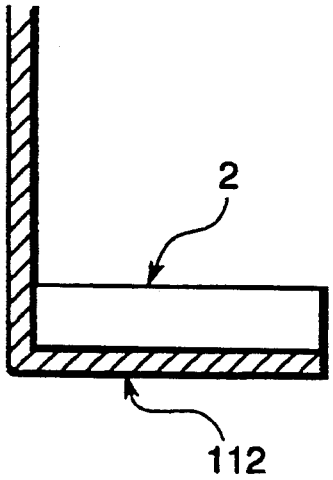
FIGS. 9 through 16 are transverse views similar to FIG. 5 but showing different embodiments of the invention.

If the curved panel A is used as the front panel of a conference table B as shown in FIG. 8, it is possible to make tables of different radii, without increasing the panel size and the number of kinds of panels and consequently the manufacturing cost. The improved quality of the curved surface of the front panel gives a good appearance to the whole table.

Figure 10:
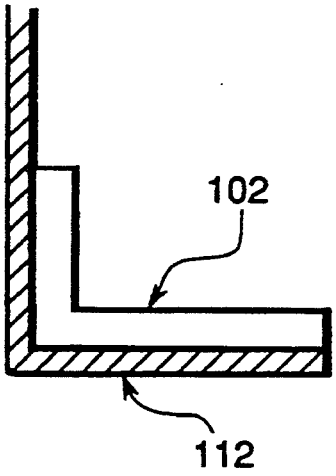
Figure 11:
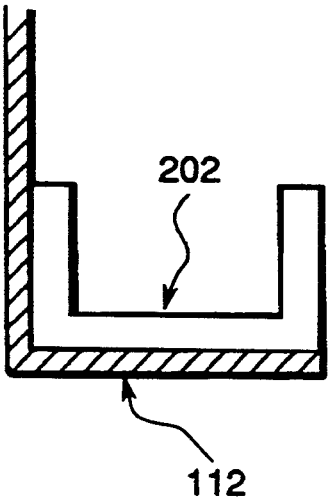
Figure 12:
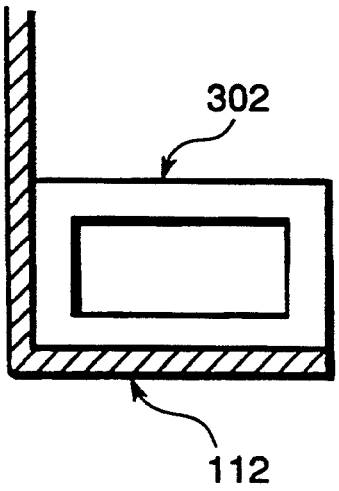
Figure 13:
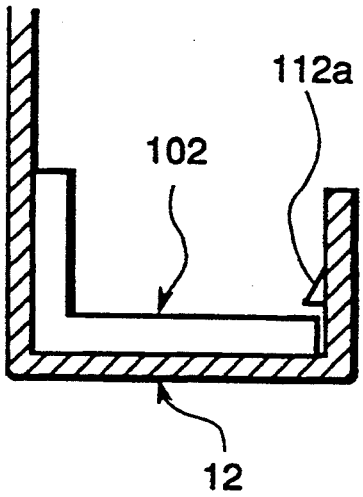
Figure 14:
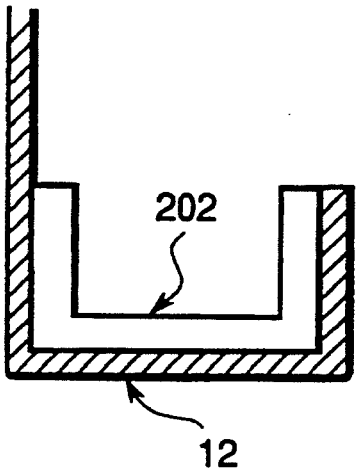
Figure 15:
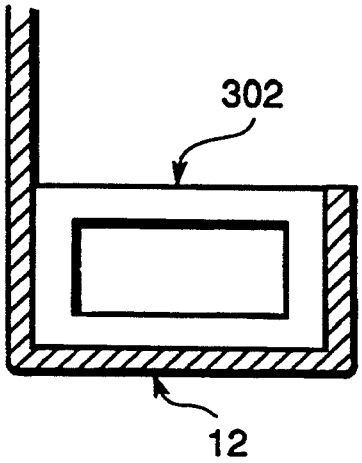
Figure 16:
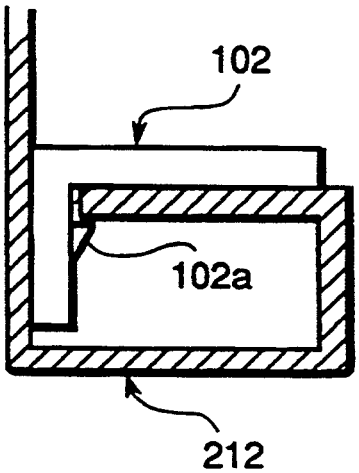

The invention is not limited to the above described embodiment. In the above embodiment, the bent portion 12 is shaped like the letter of L. A flange-like bent portion 112 as shown in FIGS. 9, 10, 11, 12, or a bent portion 212 shaped like the letter of as shown in FIG. 16 may also be used. In the above embodiments, the reinforcing members 2 are made of a thick steel plate cut to the required shape. If can also be a reinforcing angle 102 made of a steel plate bent to an L-shape in transverse section as shown in FIGS. 10, 13 and 16, or a reinforcing channel-like member 202 made of a steel plate bent to a transverse shape like the letter of as shown in FIGS. 11 and 14, or a reinforcing pipe 302 made by bending a steel plate to the shape as shown in FIGS. 12 and 15. These members may be fixed to the panel body by means of spot welding. Alternatively, it is advantageous to provide the deformable bent portions 12 with a claw 112 as shown in FIG. 13 or the reinforcing angle 102 with a claw 102*a* as shown in FIG. 16 for preventing the reinforcing member or the angle from falling off the panel body. The reinforcing member may also be made of a shape memory alloy which is restored to a greater curvature than a desired curvature when heated to a higher temperature than the normal temperature. The steel plate may be a steel plate covered by vinyl chloride film, a coated steel plate, a stainless steel plate, or a resiliently deformable synthetic resin plate. Besides the above-mentioned conference table, the curved panel may also be used in a desk whose front panel has a curved surface, a door or a partition wall whose whole surface is curved, an arched ceiling whose inner surface is curved, or a pillar whose outer circumference is covered with a hollow cylindrical decorative member.

Several embodiments having been described, the invention is not restricted to them but there may be various modifications without departing from the principle of the invention.

POSSIBLE APPLICATIONS IN INDUSTRY

As mentioned above, the curved panel of the invention is useful in application to a desk or a table whose front panel is curved, a door or a partition wall whose whole surface is curved, an arched ceiling whose inner surface is curved, or a pillar whose outer circumference is covered with a hollow cylindrical decorative member.

What is claimed is:

1. A curved panel having a predetermined curvature and comprising:

a panel body comprising a resiliently deformable material having a range of elasticity such that, when said panel body is flexed out of a planar condition while remaining within said range of elasticity, a planar restorative force biases said panel back toward said planar condition, said panel body having oppositely facing surfaces and terminating at a first pair of spaced apart edges and a second pair of spaced apart edges;

each of said first pair of edges having a reinforcing bent portion means attached thereto for maintaining a substantially straight condition of said panel along each edge of said first pair of edges;

each of said second pair of edges having a deformable bent portion means for allowing curving of said panel along each edge of said second pair of edges;

a pair of reinforcing members each of which is formed from an elongately curved member having a curvature greater than said predetermined curvature and which, when flexed from said greater curvature to a lesser curvature, provides a curvature restorative force biasing said reinforcing member back toward said greater curvature;

said reinforcing members each being attached to a corresponding deformable bent portion means and flexed toward said lesser curvature by said planar restorative force, with said curvature restorative force of said reinforcing members being balanced by said planar restorative force of said panel body at said predetermined curvature of said panel.

2. The curved panel as in claim 1, wherein each of the reinforcing members comprises:

a shape memory alloy so that each of the reinforcing members may be restored to said curvature greater than said predetermined curvature.

3. The curved panel as in claim 1, wherein each of said deformable bent portion means comprises:

a flange provided with a plurality of cuts spaced apart along a length of said deformable bent portion means.

4. The curved panel as in claim 3, wherein each of said reinforcing members comprises:

a reinforcing plate of thick steel.

5. The curved panel as in claim 3, wherein each of said reinforcing members comprises:

a reinforcing angle of steel plate and L-shaped, in transverse section,

6. The curved panel as in claim 3, wherein each of said reinforcing members comprises:

a reinforcing channel member of steel plate and L-shaped, in transverse section.

7. The curved panel as in claim wherein each of said reinforcing members comprises:

a hollow reinforcing pipe of bent steel plate.

8. The curved panel as in claim 1, wherein each of said deformable bent portion means comprises an L-shaped flange provided with a plurality of cuts spaced apart along a length of said deformable bent portion means.

9. The curved panel as in claim 8, wherein each of the reinforcing members comprises:

a reinforcing plate of thick steel plate.

10. The curved panel as in claim 8, wherein each of the reinforcing members comprises:

a reinforcing angle of steel plate and L-shaped, in transverse section.

11. The curved panel as in claim 8, wherein each of the reinforcing members comprises:

a reinforcing channel member of bent steel plate and U-shaped, in transverse section.

12. The curved panel as in claim 8, wherein each of the reinforcing members comprises:

a hollow reinforcing pipe of bent steel plate.

13. The curved panel as in claim 1, wherein each of said deformable bent portion means comprises:

a U-shaped flange provided with a plurality of cuts spaced apart along a length of said deformable bent portion means.

14. The curved panel as in claim 13, wherein each of the reinforcing members comprises:

a reinforcing angle of steel plate and L-shaped, in transverse section.

* * * * *